US009295867B1

(12) United States Patent
DeVore

(10) Patent No.: US 9,295,867 B1
(45) Date of Patent: Mar. 29, 2016

(54) TRAMPOLINE NET

(71) Applicant: Pamela M. DeVore, Beaumont, TX (US)

(72) Inventor: Pamela M. DeVore, Beaumont, TX (US)

( * ) Notice: Subject to any disclaimer, the term of this patent is extended or adjusted under 35 U.S.C. 154(b) by 297 days.

(21) Appl. No.: 14/037,509

(22) Filed: Sep. 26, 2013

Related U.S. Application Data

(60) Provisional application No. 61/706,871, filed on Sep. 28, 2012.

(51) Int. Cl.
*A63B 5/11* (2006.01)

(52) U.S. Cl.
CPC ..... *A63B 5/11* (2013.01)

(58) Field of Classification Search
CPC ..... A63B 21/00
USPC ..... 482/27, 28
See application file for complete search history.

(56) References Cited

U.S. PATENT DOCUMENTS 3,339,925 A * 9/1967 Nissen ..... 473/469
5,833,557 A * 11/1998 Cole ..... 473/472
7,758,471 B2 7/2010 Nelson

* cited by examiner

*Primary Examiner* — Jerome W Donnelly
(74) *Attorney, Agent, or Firm* — Howard L. Speight, PLLC

(57) ABSTRACT

An apparatus includes a trampoline frame. The apparatus further includes a trampoline mat attached to the trampoline frame and a trampoline net attached to the trampoline mat. The trampoline net is in position to catch a jumper that falls through the trampoline mat in the event of failure of the trampoline mat.

20 Claims, 12 Drawing Sheets

TRAMPOLINE NET

CROSS-REFERENCE TO RELATED APPLICATIONS

This application claims priority from U.S. Provisional Application No. 61/706,871, entitled "Trampoline Net," filed on Sep. 28, 2012.

BACKGROUND

Trampolines are a popular recreational device. New industry standards seek to increase trampoline safety. It is a challenge to meet the new industry standards in a maintainable product.

DETAILED DESCRIPTION

Figure 1:
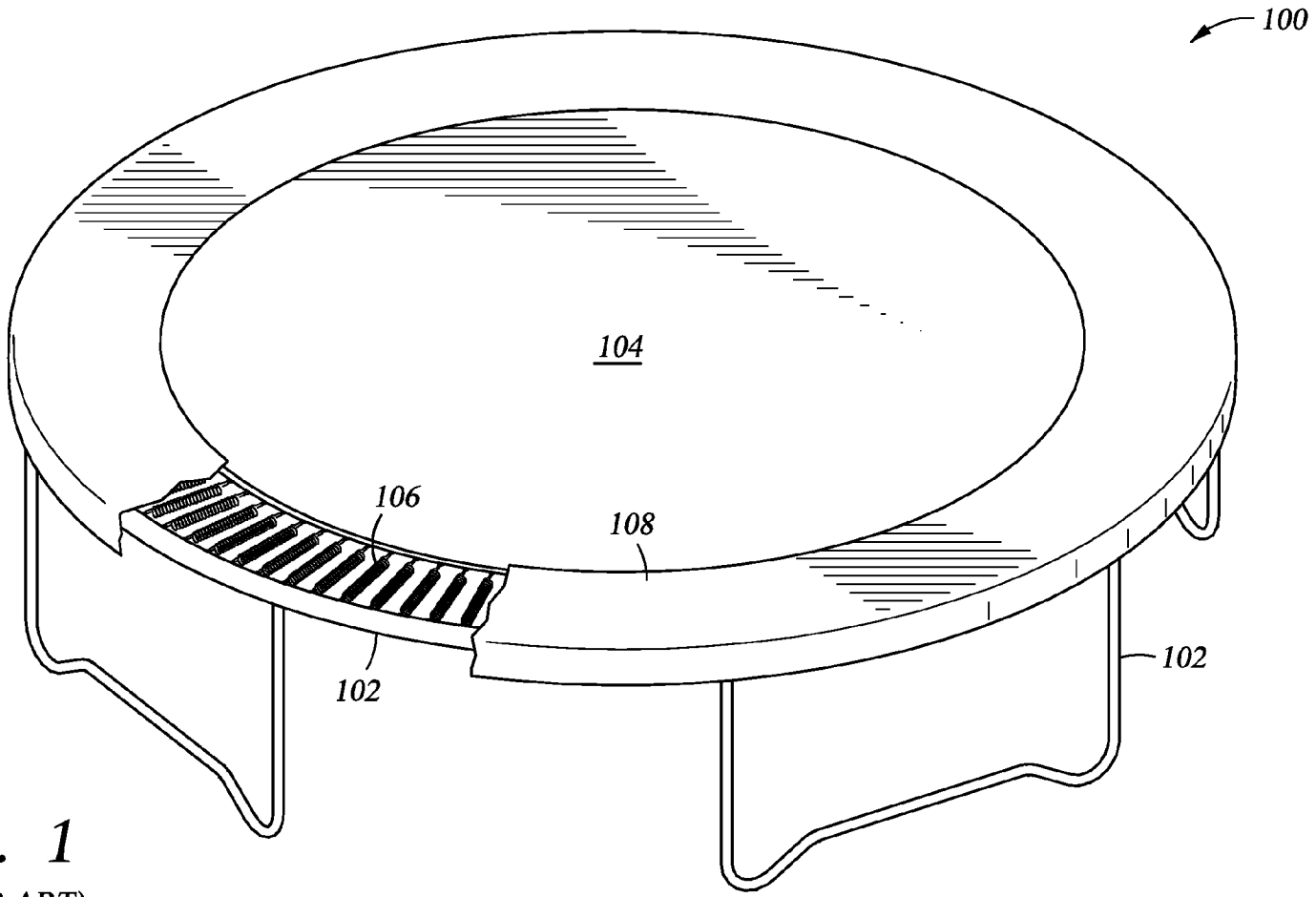
Fig. 1 (PRIOR ART)
FIG. 1 illustrates a round trampoline.

A circular trampoline 100, illustrated in FIG. 1, includes a frame 102 and a mat 104. Springs 106 couple the mat 104 to the frame 102. A frame pad 108 is positioned over the springs 106 to protect a user whose jumps cause him or her to land on the outer portions of the mat 104.

Figure 2:
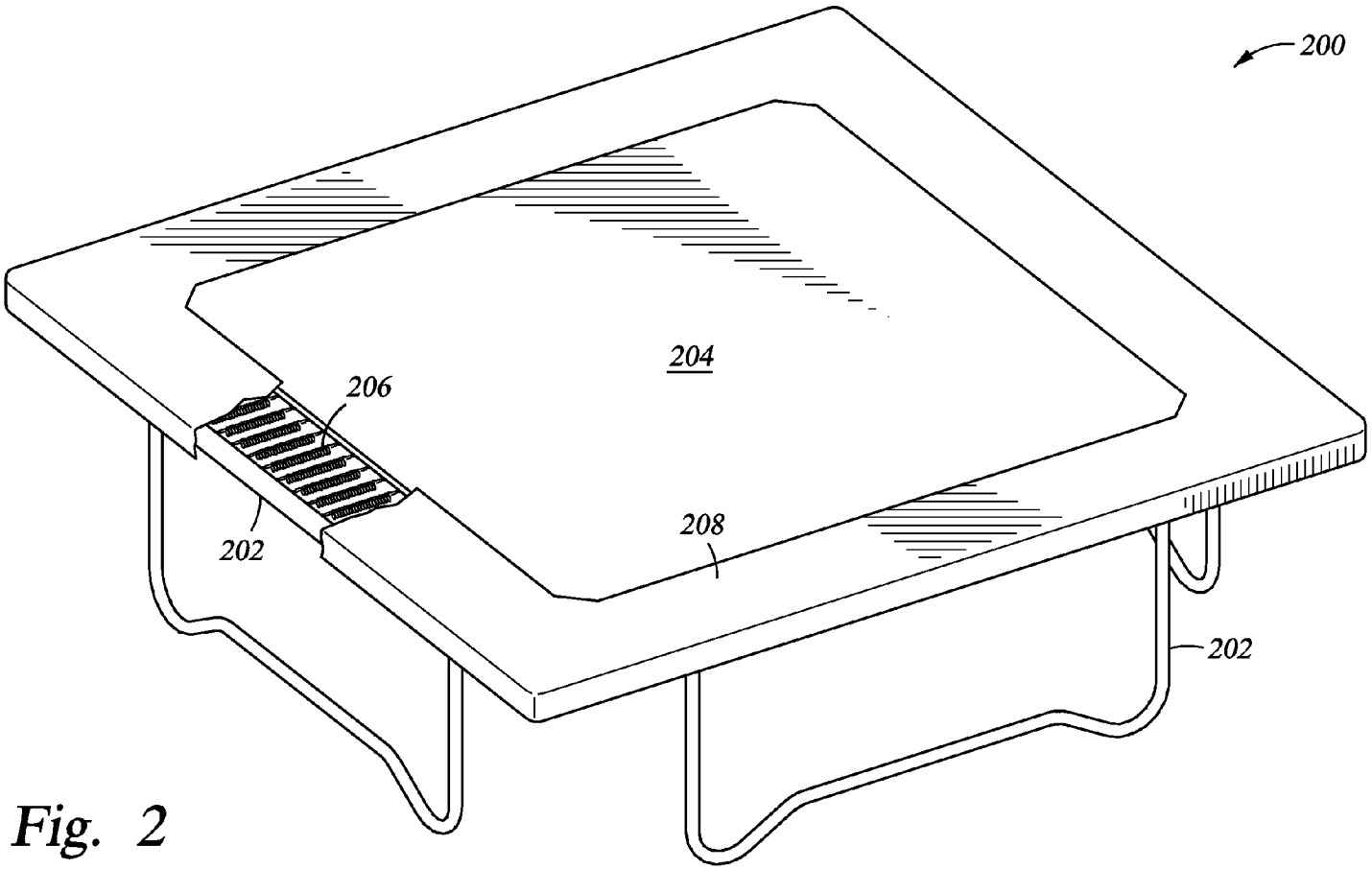
Fig. 2 (PRIOR ART)
FIG. 2 illustrates a rectangular trampoline.

A rectangular trampoline 200, illustrated in FIG. 2, includes a frame 202 and a mat 204. Springs 206 couple the mat 204 to the frame 202. A frame pad 208 is positioned over the springs 206.

Figure 3:
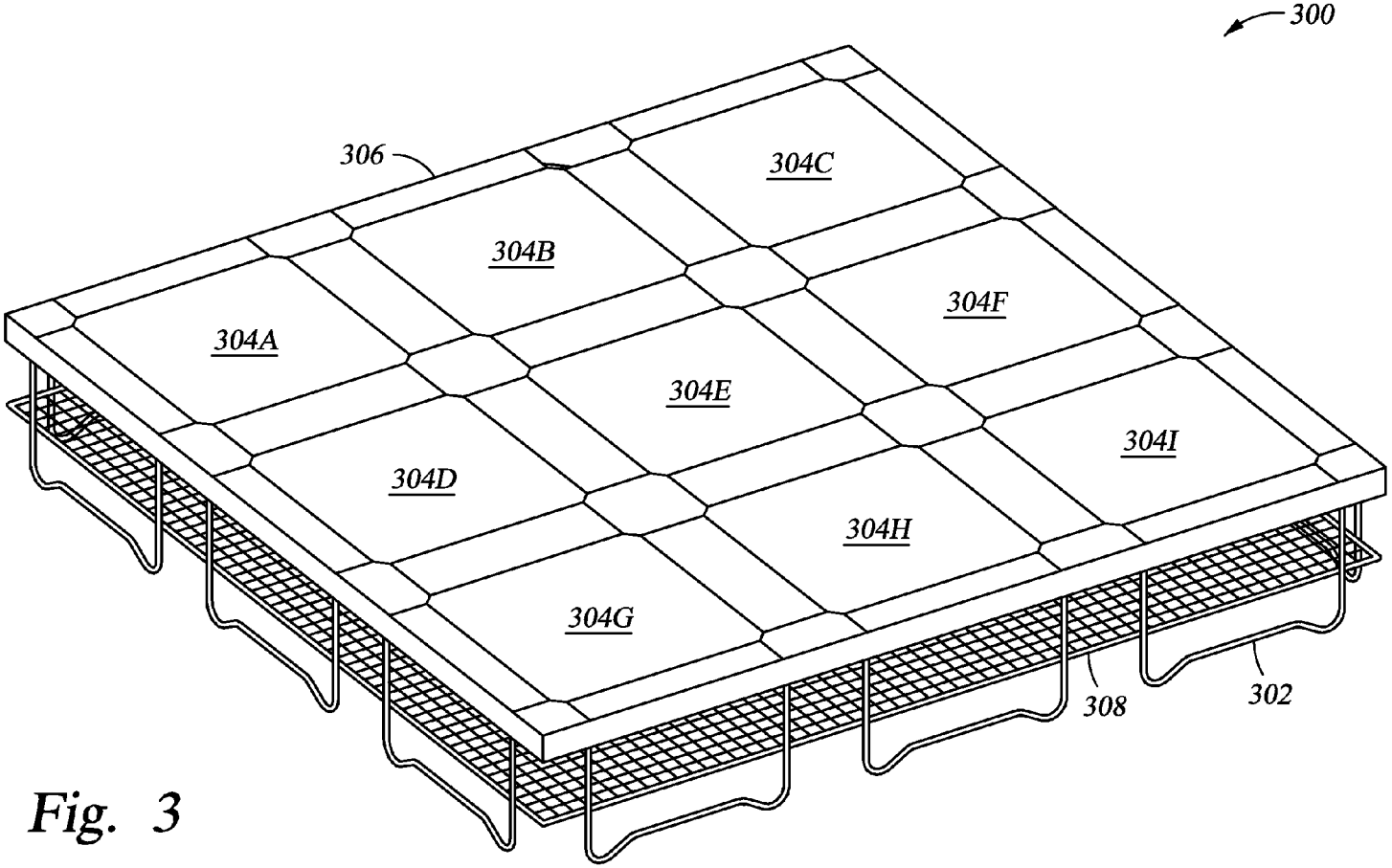
FIG. 3 illustrates a trampoline court.

A trampoline court 300, illustrated in FIG. 3, includes a frame or frames 302 that support a plurality of mats 304A-I. Springs (not shown) couple the mats 304A-I to the frame 302 in a similar manner to that shown in FIGS. 1 and 2. One or more frame pads 306 surrounding each of the mats 304A-I are positioned over the springs to protect users. A trampoline court 300, such as that shown in FIG. 3, allows a plurality of users to jump on trampolines simultaneously. In one embodiment, a net 308 extends under all of the mats 304A-I. The net 308 acts as a safety measure required by industry standards to catch any jumpers that break through a mat 304A-I and keep them from hitting the floor below the trampoline court 300.

Figure 4:
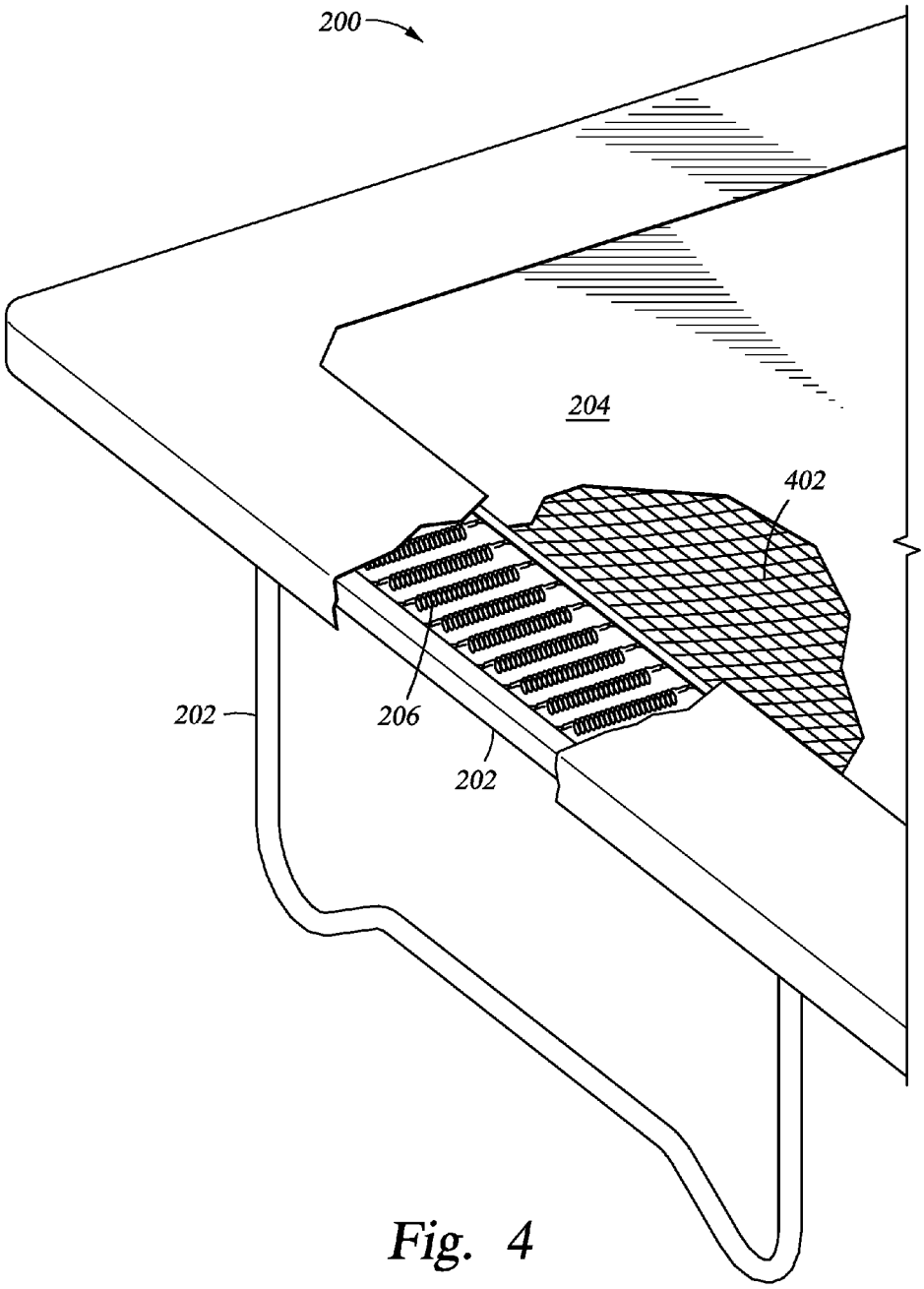
FIGS. 4 and 5 illustrate a trampoline with a net.
Figure 5:
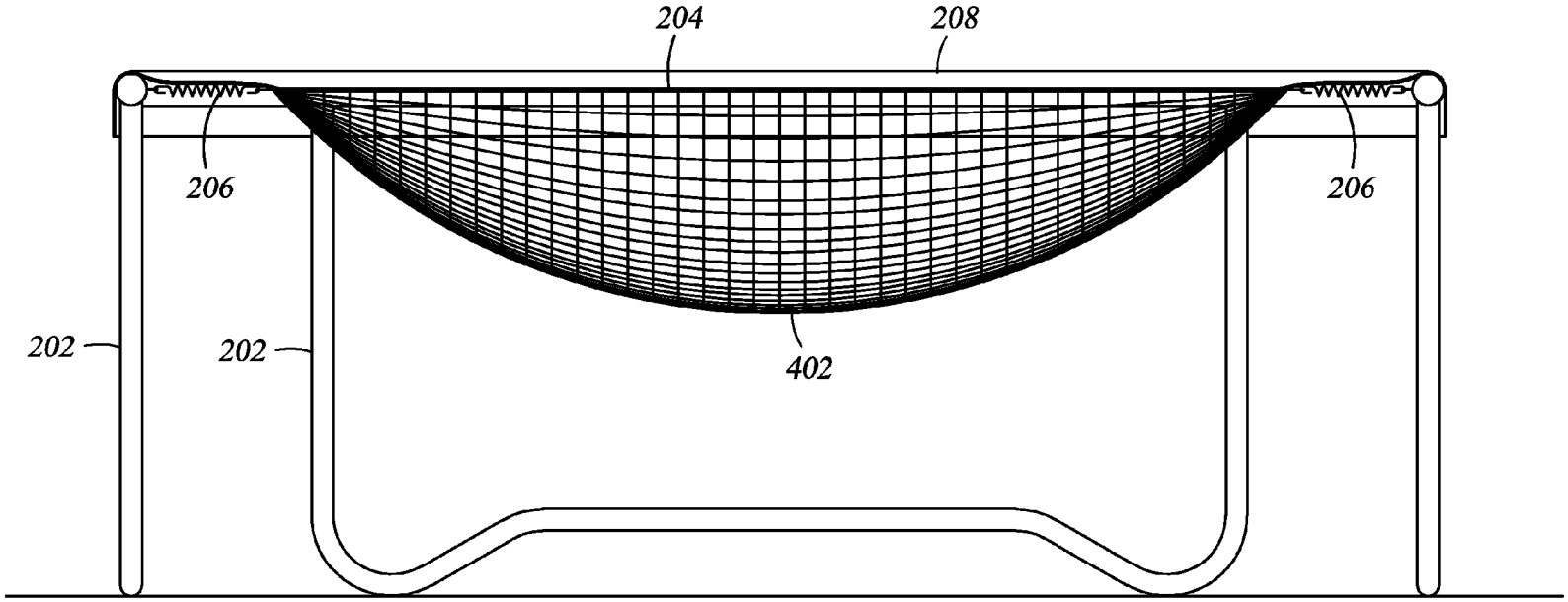

In one embodiment, shown in FIGS. 4 and 5, a net 402 is suspended below the mat 204. Note that while FIGS. 4 and 5 illustrate a square trampoline, such as that shown in FIG. 2, the same arrangement would work for a round trampoline 100, such as that shown in FIG. 1, or in a trampoline court 300 as shown in FIG. 3. In a round trampoline 100, the net 402 would be suspended below the mat 104.

Figure 6:
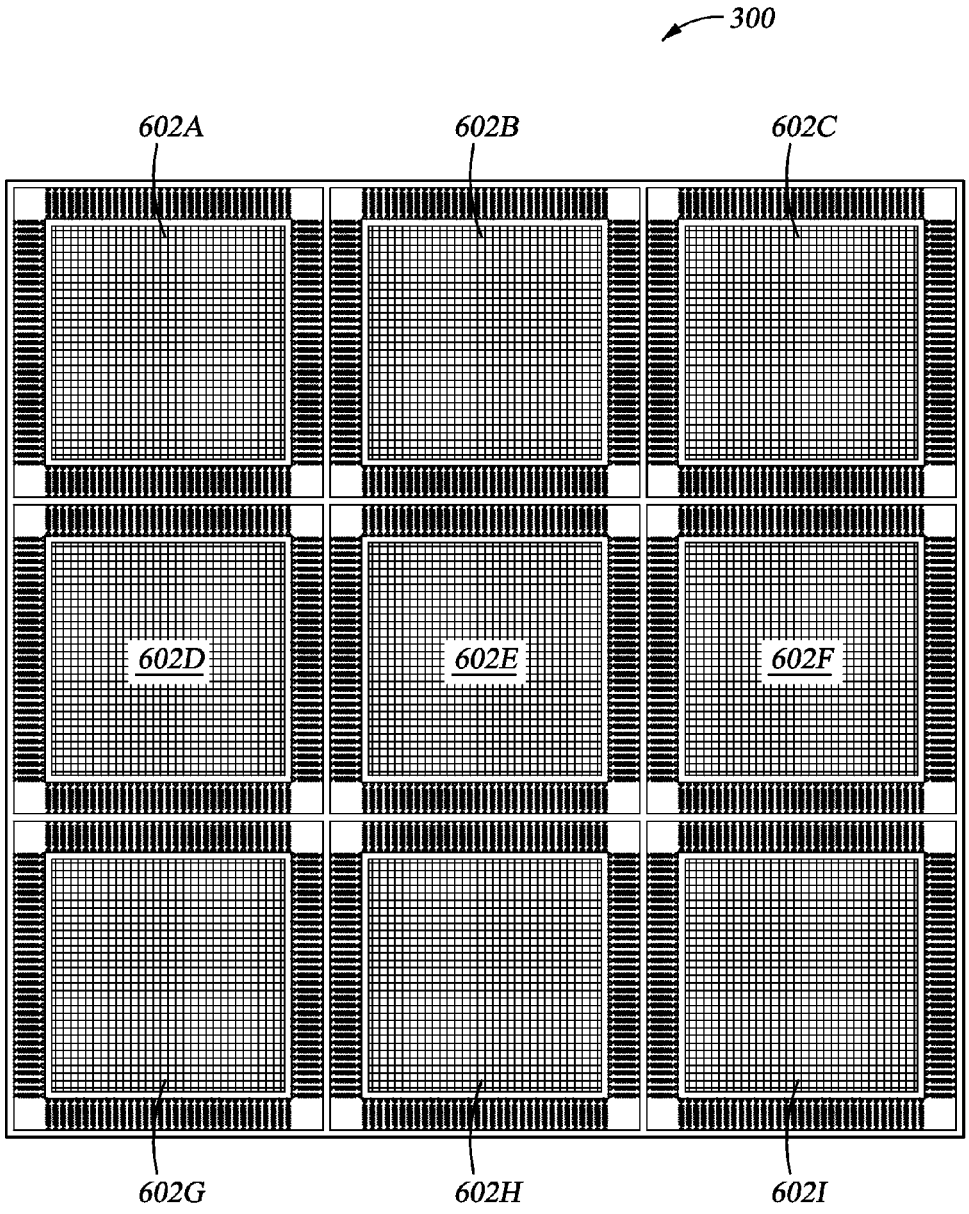
FIG. 6 illustrates a trampoline court in which at least some of the trampoline mats have their own nets.

In one embodiment, shown in FIG. 6 (which shows trampoline court 300 with the mats 304A-I cut away), each mat 304A-I is undergirded by its own net 602A-I. Providing each mat 304A-I with its own net 602A-I improves the maintainability of a trampoline court 300 over the approach shown in FIG. 3 in which the single net 308 extends under all of the trampolines in the trampoline court 300. If a mat 304E fails, it will be easier to access and replace the failed mat in the arrangement shown in FIG. 6 than in the arrangement shown in FIG. 3.

Figure 7:
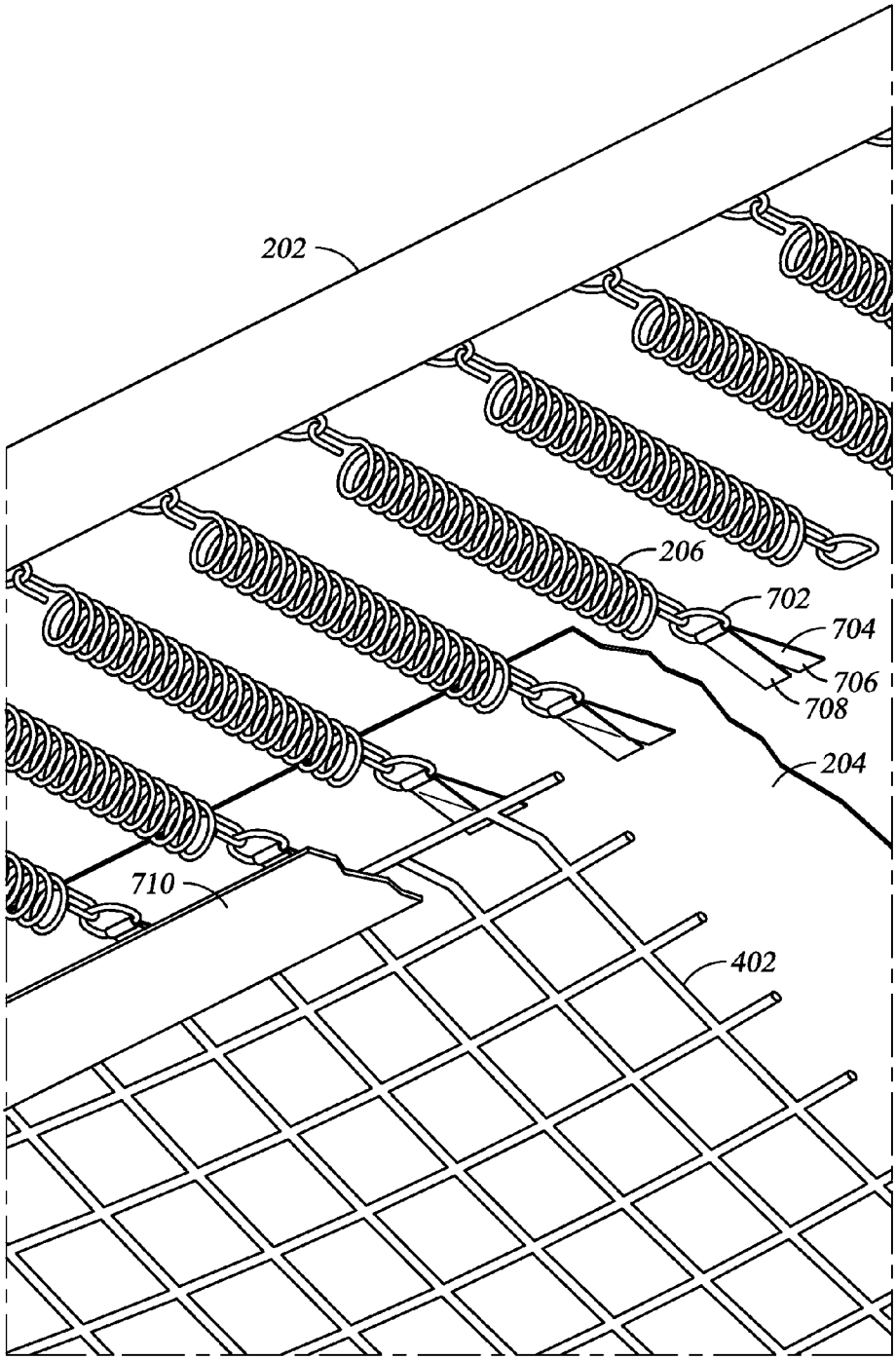
FIG. 7 illustrates an embodiment of the attachment of the trampoline net to the trampoline mat.

In one embodiment, shown in FIG. 7, D-rings 702 (only one is labeled) are attached to the springs 206. In one embodiment, straps 704 (only one is labeled) are attached to the D-rings. In one embodiment, the straps 704 are made of a high-strength fabric, such as nylon. In one embodiment, the straps are wrapped around a straight portion of the D-ring to form two wings of material 706 and 708 (only one set is labeled). In one embodiment, the two wings of material 706 and 708 are secured together, for example by sewing them together, just outside the D-ring 702 so that a pocket is formed around the D-ring 702.

In one embodiment, the two wings of material are placed against an under side of the mat 204 (the under side is the opposite of the side of mat 104 shown in FIG. 1, mat 204 shown in FIG. 2, and mats 304A-I in FIG. 3). In one embodiment, the net 402 is placed over the wings of material 706 and 708. In one embodiment, an optional strip of backing material 710 is placed over the wings of material 706 and 708 and the net. In one embodiment, the strip of backing material 710 is sewed to the mat 204. In one embodiment, sewing the strip of backing material 710 to the mat 204 also secures the wings of material 706 and 708 and the edge of the net 402 to the underside of the mat 204. In one embodiment, the strip of backing material 710, the wings of material 706 and 708, and the edge of the net 402 are sewed to the mat as shown in FIG. 7 along the entire edge of the mat. In one embodiment, the sewing is done with zigzagged stitches. In one embodiment, the sewing is done with six zigzagged stitches. In one embodiment, the result is the net 402 is stretched below the mat 204 in such a way that if the mat 204 tears or otherwise breaks, the net 402 will catch a jumping person that falls through the mat 204.

Figure 8:
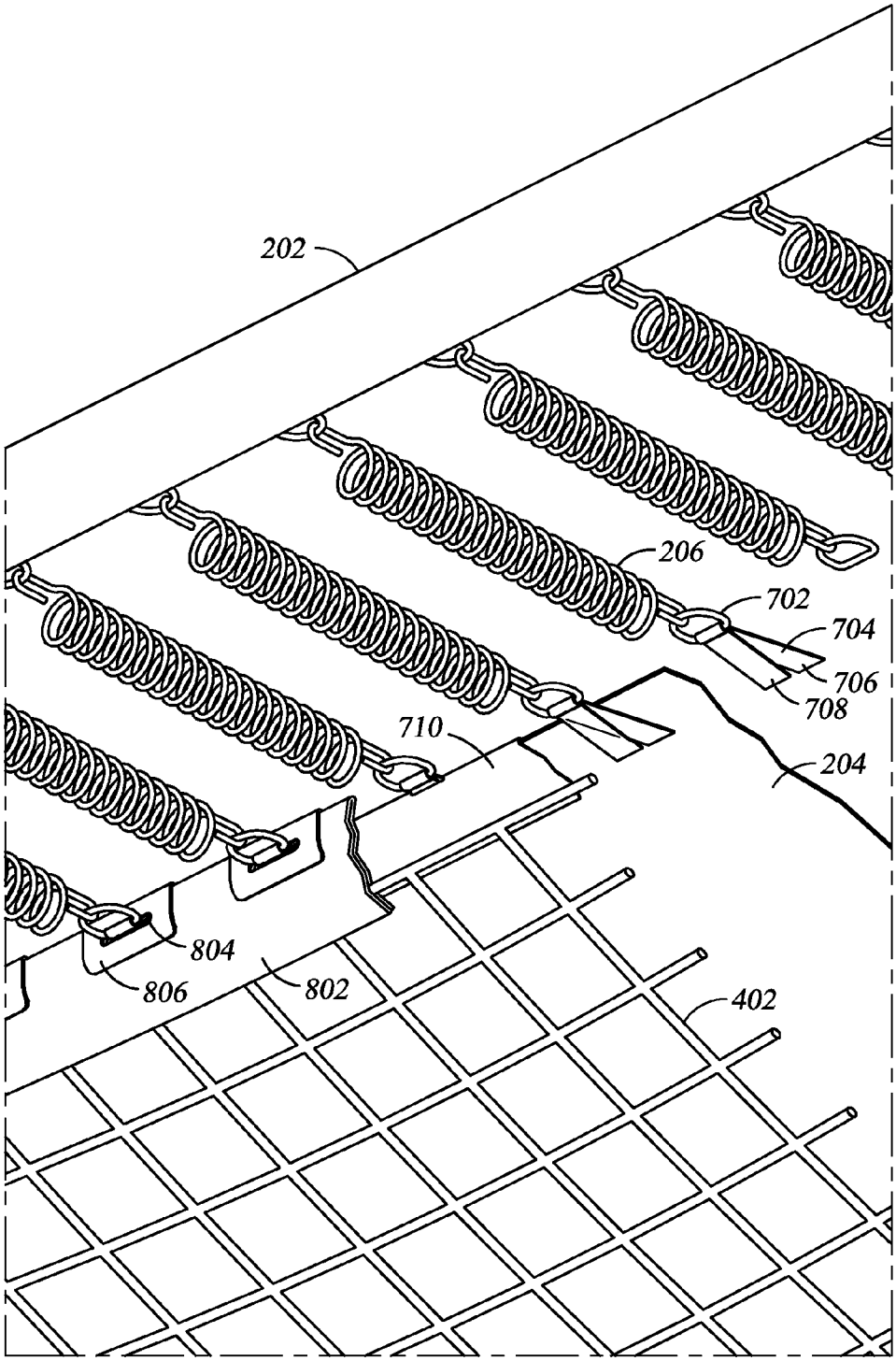
FIG. 8 illustrates an embodiment in which the trampoline net is coupled to the frame using buttonholes.

In one embodiment, shown in FIG. 8, the strip of backing material 710 and the wings of material 706 and 708 are attached to the mat 204 as described above. In one embodiment, the net 402 is attached to the springs using a buttonhole technique. In one embodiment, a strip of backing material 802 is attached to the edge of the net 402. Buttonholes 804 are cut in the strip of backing material 802 at intervals that correspond to the spacing between the springs 206. Reinforcing material 806 is added around the buttonholes to prevent the strip of backing material 802 from tearing when placed under load of a jumper on the trampoline.

In one embodiment, the trampoline is assembled by placing the buttonholes 804 over the D-rings 702 before attaching the D-rings to the springs 206. The result is that the net 402 is attached to the springs 206 and therefore to the frame 202 in the same way the mat 204 is attached.

Figure 9:
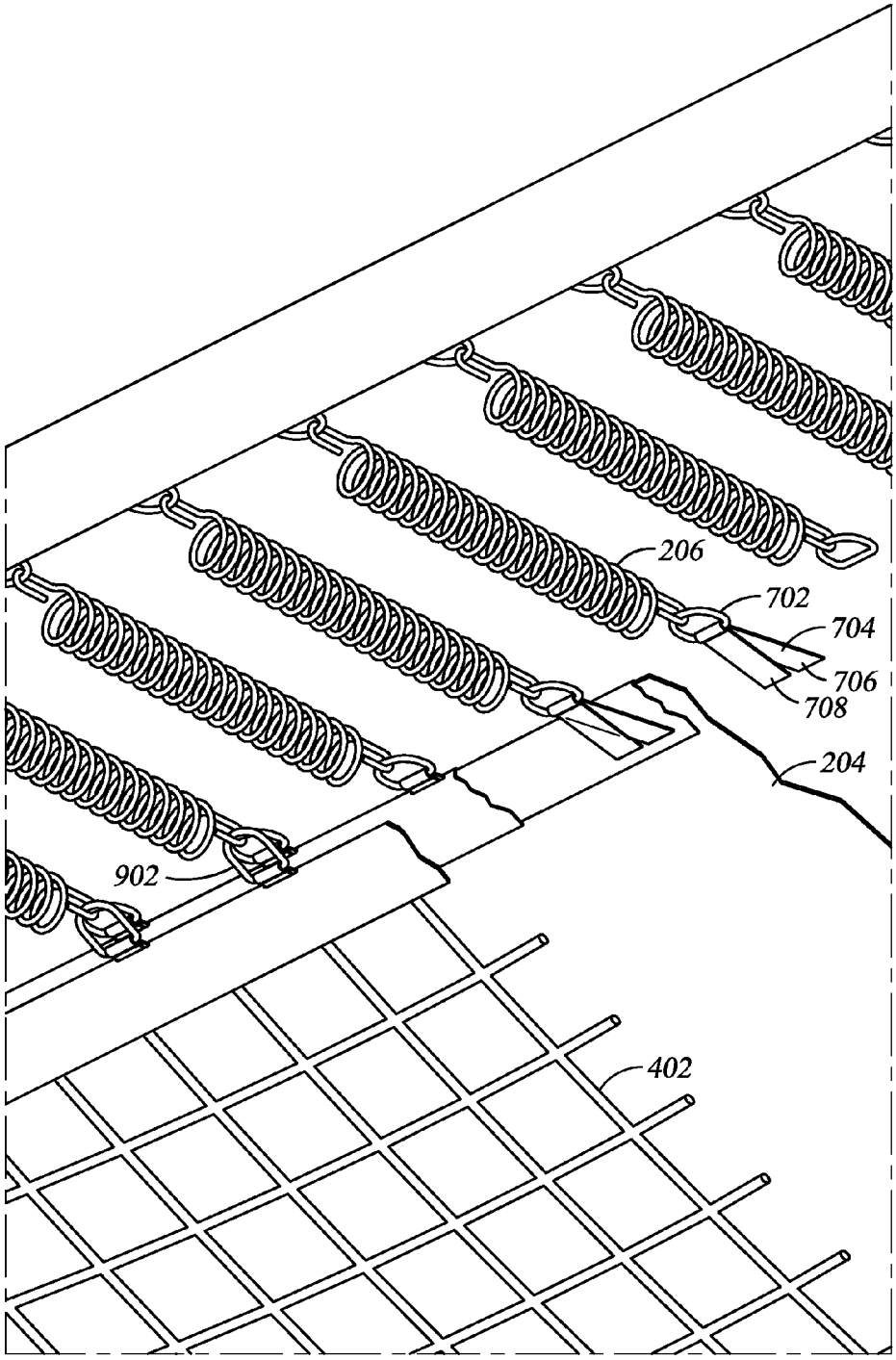
FIG. 9 illustrates an embodiment in which the trampoline net is coupled to the springs.

In one embodiment, shown in FIG. 9, the net has its own set of D-rings 902 separate from the D-rings 702. The D-rings 902 are used to attach the net to the springs 206. The D-rings 902 are attached to the net 402 in the same way that the D-rings 702 are attached to the mat as described above with respect to FIG. 7.

Figure 10:
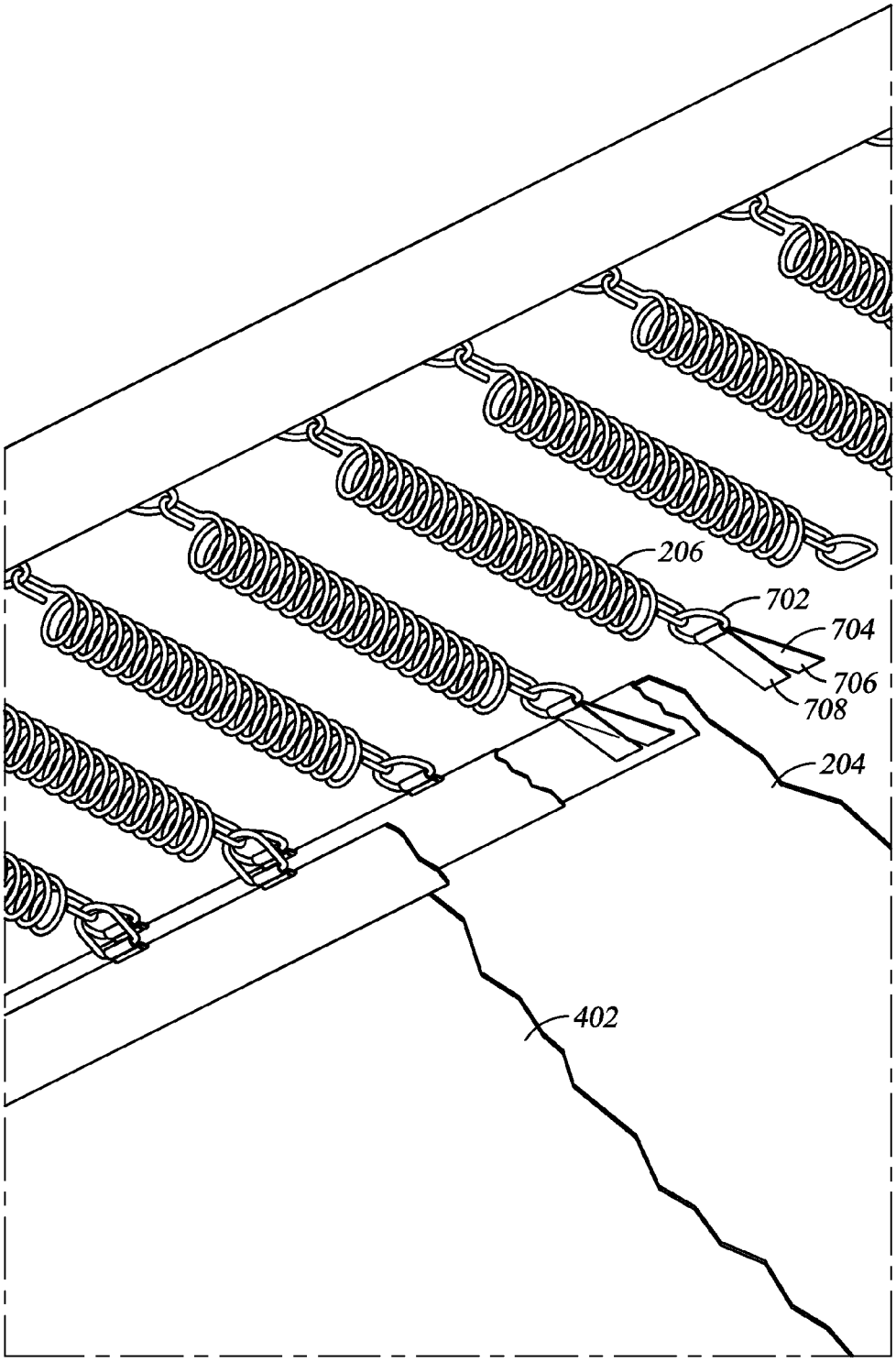
FIG. 10 illustrates an embodiment in which the trampoline net is solid and is not a mesh.

In one embodiment, shown in FIG. 10, the net 402 is solid like the mat 204. That is, in the embodiment shown in FIG. 10, the net 402 is not a mesh as shown in the net 402 in FIGS. 7-9.

Figure 11:
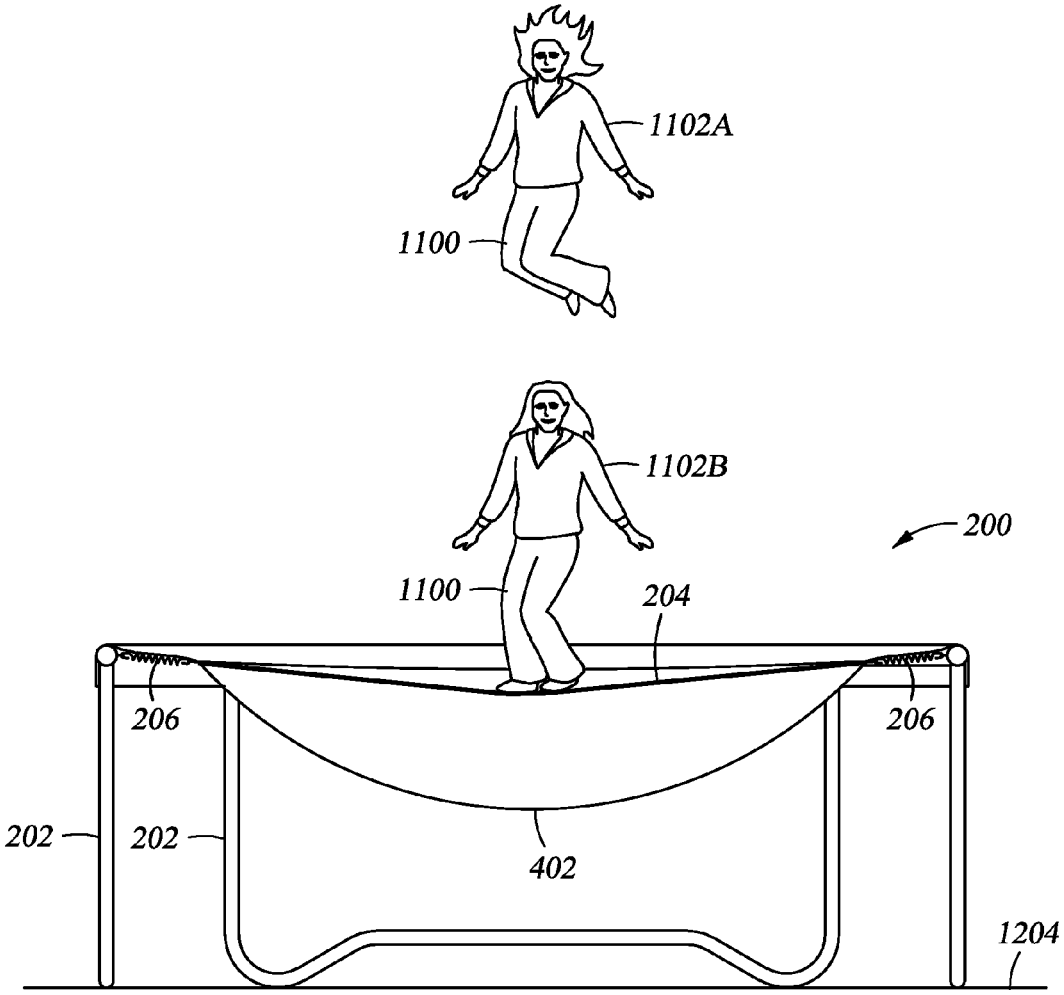
FIGS. 11 and 12 illustrate the operation of the trampoline net.

FIG. 11 shows a jumper 1100 in a position 1102A elevated above the trampoline 200. When the jumper falls to position 1102B, the mat 204 deflects downward and stretches the springs 206. The recoil of the springs 206 causes the mat to deflect upward and propel the jumper back toward position 1102A.

Figure 12:
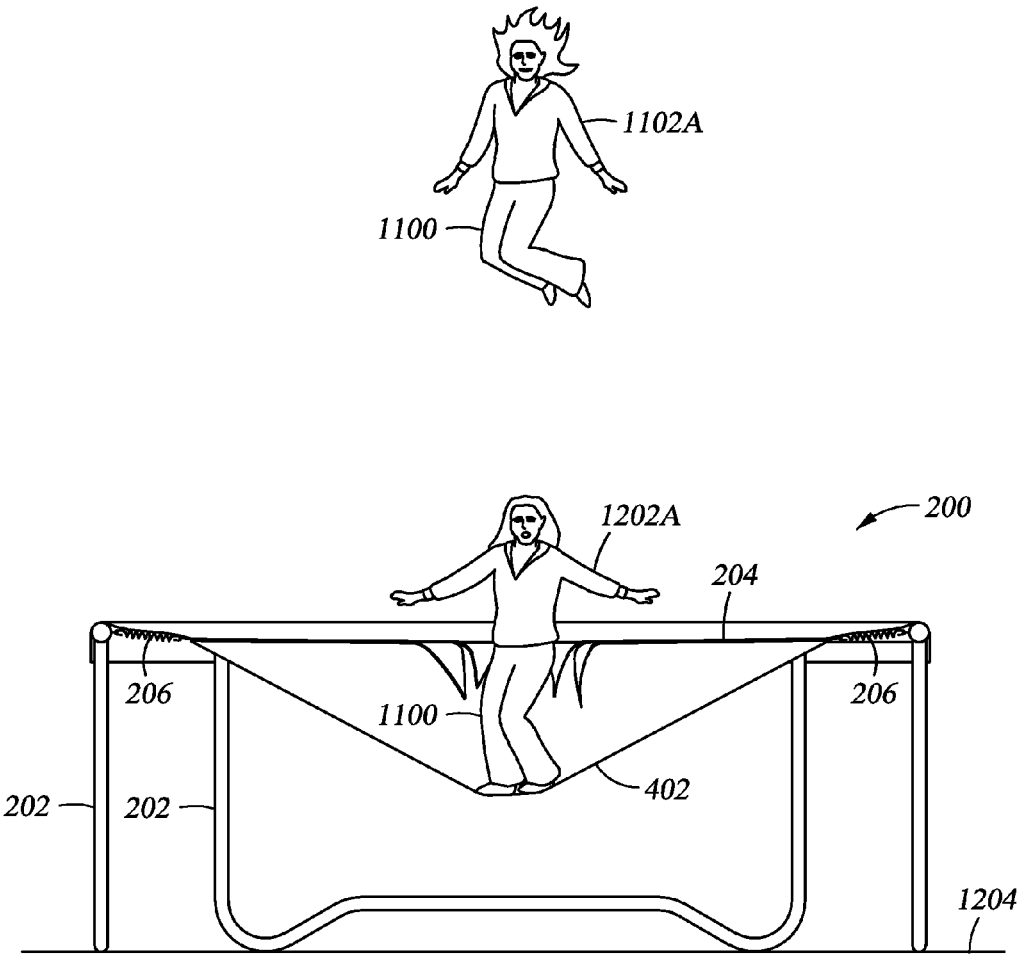

FIG. 12 shows the jumper 1100 descending from position 1102A and breaking through the mat 204. Rather than falling through to the floor 1204, however, the net 402 catches the jumper 1100 at position 1202A, perhaps preventing the jumper 1100 from injuring herself.

The foregoing description of the preferred embodiment of the invention has been presented for the purposes of illustration and description. It is not intended to be exhaustive or to limit the invention to the precise form disclosed. Many modifications and variations are possible in light of the above teaching. For example, while the description is of circular and rectangular trampolines, the invention can be used with trampolines of any shape, including square, octagonal, polygonal, oval, or any other geometric shape. It is intended that the scope of the invention be limited not by this detailed description, but rather by the claims appended hereto.

What is claimed is:

1. An apparatus comprising:
a trampoline frame;
a trampoline mat attached to the trampoline frame; and
a trampoline net attached to the trampoline mat;
wherein the trampoline net is in position to catch a jumper that falls through the trampoline mat in the event of failure of the trampoline mat.

2. A method comprising
attaching a trampoline mat to a trampoline frame; and
attaching a trampoline net to the trampoline frame below the trampoline mat.

3. The method of claim 2 wherein attaching the trampoline net to the trampoline frame comprises attaching the trampoline net to the trampoline mat.

4. The method of claim 2 wherein:
attaching the trampoline mat to the trampoline frame comprises:
attaching springs to the trampoline frame,
attaching D-rings to the trampoline mat, and
attaching the D-rings to the springs; and
the method further comprises attaching the trampoline net to the trampoline mat by:
attaching a strip of backing material to the trampoline net;
cutting buttonholes in the strip of backing material;
placing the D-rings through the buttonholes before attaching the D-rings to the springs.

5. The apparatus of claim 1, further comprising:
a second trampoline net attached to an under side of the trampoline mat.

6. The apparatus of claim 5, wherein:
the trampoline net is attached to a first area of the trampoline mat; and
the second trampoline net is attached to a second area of the trampoline mat, different from the first area of the trampoline mat.

7. The method of claim 3 wherein attaching the trampoline net to the trampoline frame comprises attaching a second trampoline net to an under side of the trampoline mat.

8. The method of claim 7, wherein attaching the second trampoline net to the under side of the trampoline mat comprises sewing a zigzag stitch.

9. The method of claim 7, further comprising:
sewing a strip of backing material to the under side of the trampoline mat;
wherein an edge of the second trampoline net and a first wing of a strap are between the strip of backing material and the under side of the trampoline mat.

10. The method of claim 7, further comprising:
sewing to the under side of the trampoline mat with a stitch:
a strap having a first wing,
a strip of backing material, and
an edge of the second trampoline net.

11. The method of claim 3 further comprising:
attaching a spring to the trampoline frame; and
wherein attaching the trampoline net to the trampoline frame comprises attaching the trampoline net to the spring.

12. The method of claim 11, further comprising:
coupling a trampoline net ring to the spring;
wherein attaching the trampoline net to the trampoline frame comprises coupling the trampoline net to the trampoline net ring.

13. The method of claim 11, further comprising:
coupling a trampoline mat ring to the spring;
wherein attaching the trampoline mat to the trampoline frame comprises coupling the trampoline mat to the trampoline mat ring.

14. The method of claim 11, further comprising:
coupling a trampoline net ring to the spring;
attaching a strip of backing material to an edge of the trampoline net, the strip of backing material comprising:
an attachment portion attached to the trampoline net; and
a buttonhole portion that is not attached to the trampoline net and has a buttonhole;
coupling a strap to the trampoline net ring, wherein the strap has a wing attached to the trampoline net between the attachment portion of the strip of backing material and the trampoline net; and
attaching a reinforcing material to the buttonhole portion of the strip of backing material around the buttonhole;
wherein the trampoline net ring passes through the buttonhole and the reinforcing material.

15. The method of claim 14, further comprising:
forming a pocket around the trampoline net ring with the strap.

16. The method of claim 2, further comprising:
attaching the trampoline net to a first area of the trampoline mat; and
attaching the second trampoline net to a second area of the trampoline mat;
wherein the second area of the trampoline mat is different from the first area of the trampoline mat.

17. An apparatus comprising:
a trampoline frame;
a trampoline mat attached to the trampoline frame; and
a first trampoline net attached to the trampoline frame below the trampoline mat.

18. The apparatus of claim 17, further comprising:
a spring attached to the trampoline frame;
a trampoline net ring coupled to the spring;
wherein the first trampoline net is coupled to the trampoline net ring.

19. The apparatus of claim 18, further comprising:
a trampoline mat ring coupled to the spring, wherein the trampoline mat ring is different from the trampoline net ring;
wherein the trampoline mat is coupled to the trampoline mat ring.

20. The apparatus of claim 18, further comprising:

a strip of backing material attached to an edge of the first trampoline net comprising:

an attachment portion of the strip of backing material attached to the first trampoline net, and a buttonhole portion of the strip of backing material that is not attached to the first trampoline net;

a strap coupled to the trampoline net ring, wherein the strap has a wing attached to the first trampoline net between the attachment portion of the strip of backing material and the first trampoline net;

a buttonhole in the buttonhole portion of the strip of backing material; and a reinforcing material attached to the buttonhole portion of the strip of backing material around the buttonhole;

wherein the trampoline net ring passes through the buttonhole and the reinforcing material.

* * * * *